United States Patent [19]

Gargrave

[11] 4,277,994

[45] Jul. 14, 1981

[54] MATRIX ELEMENT

[76] Inventor: Robert J. Gargrave, 4717 James Hill Rd., Dayton, Ohio 45425

[21] Appl. No.: 41,535

[22] Filed: May 22, 1979

Related U.S. Application Data

[63] Continuation of Ser. No. 842,526, Oct. 17, 1977, abandoned.

[51] Int. Cl.[3] ..... B26F 1/02

[52] U.S. Cl. ..... 83/133; 83/140; 83/685; 83/690; 83/691

[58] Field of Search ..... 83/690, 691, 685, 133, 83/140, 687

[56] References Cited

U.S. PATENT DOCUMENTS

| | | | |
|---|---|---|---|
| 407,242 | 7/1889 | Quinn | 83/691 |
| 1,612,156 | 12/1926 | Small | 83/133 |
| 1,613,766 | 1/1927 | Parcher | 83/687 |
| 1,623,824 | 4/1927 | Bondeson et al. | 83/685 X |
| 1,942,539 | 1/1934 | Deubel | 83/698 X |
| 2,017,247 | 10/1935 | Hodge | 83/687 X |
| 2,100,846 | 11/1937 | Halstead | 83/691 X |
| 2,272,069 | 2/1942 | Raiche | 83/687 X |
| 2,287,168 | 6/1942 | Duncan | 83/685 |
| 2,346,925 | 4/1944 | Lewis | 83/698 X |
| 2,375,445 | 5/1945 | Sines | 83/685 X |
| 2,584,415 | 2/1952 | Barnett | 83/133 |

*Primary Examiner*—Frank T. Yost
*Attorney, Agent, or Firm*—Jerome P. Bloom

[57] ABSTRACT

For use in combination with a die plate having through bores, matrix means for mounting to the die plate including die means for cooperation with tools of a die assembly to function therewith to work material fed therebetween, one end of said matrix means being constituted by a matrix segment the external dimension of which is greater than that of the through bores in the die plate, the matrix means also including a mounting segment dimensioned for a press fit within a through bore of the die plate, providing thereby that the outer peripheral portion of the matrix segment will seat on the die plate. The matrix means has a passage therethrough at least a defined portion of the length of which within the matrix segment has a uniform cross sectional area. The operating surface portion of said matrix means, provided by said matrix segment, positions outermost from the die plate to which it is applied to define a limited matrix surface displaced from the die plate. In use thereof, a plurality of said matrix means, as applied to a die plate, have the limited areas of their operating surfaces cooperatively arranged to be co-planar and to support the material to be worked during feed thereof to and during the working thereof by the applied tools.

2 Claims, 3 Drawing Figures

FIG-1
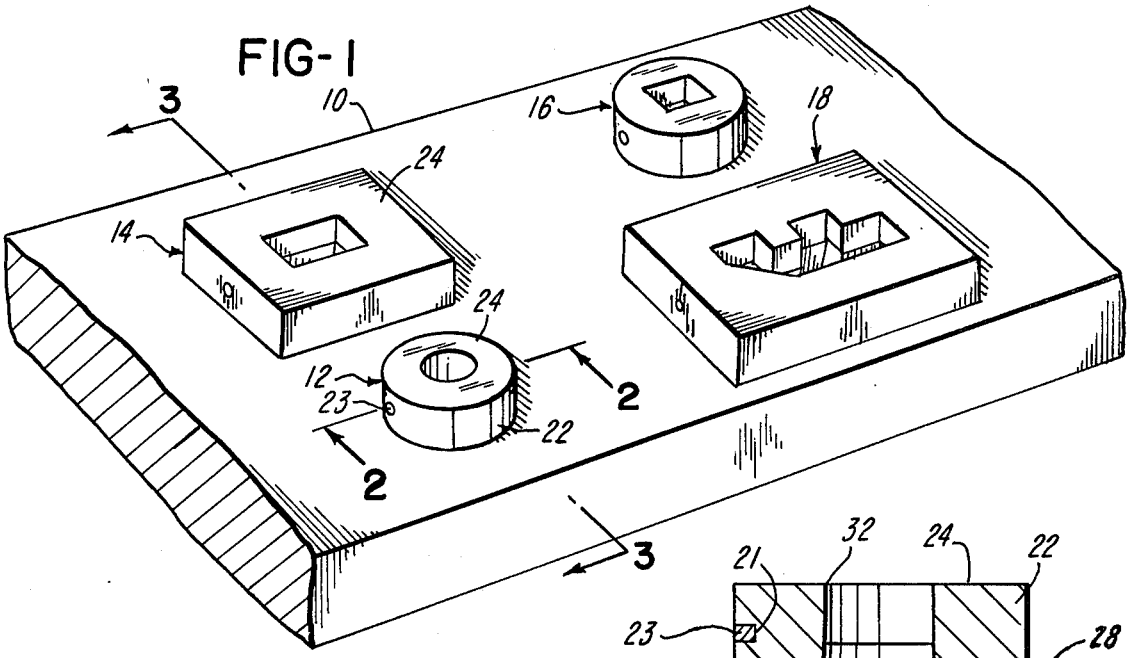
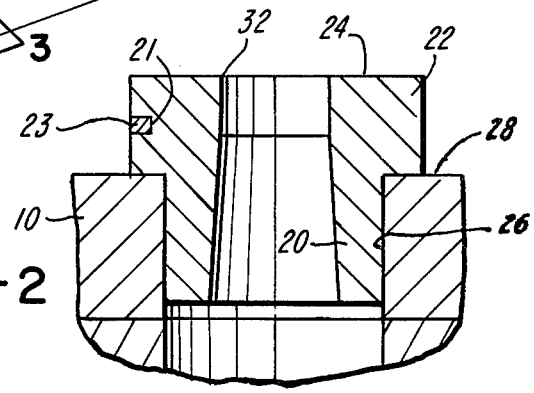
FIG-2
FIG-3
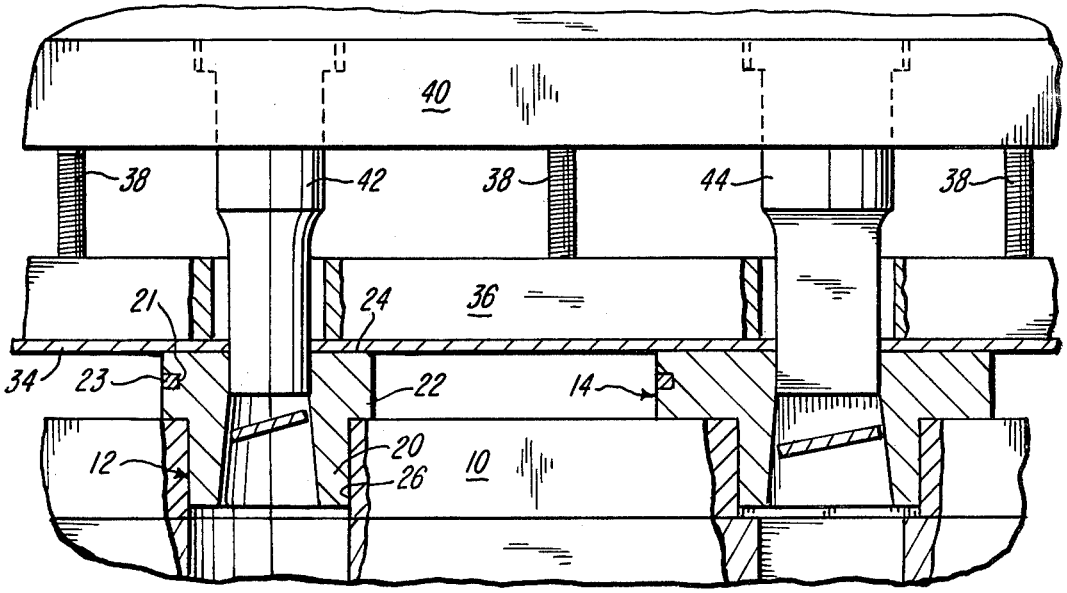

MATRIX ELEMENT

This application is a continuation of applicant's previously co-pending application for U.S. Letters Pat. Ser. No. 842,526, filed Oct. 17, 1977 for "MATRIX ELEMENT", now abandoned in favor of the present application.

BACKGROUND OF THE INVENTION

This invention relates to means providing a new and improved matrix for a die assembly in a stamping, press or like machine. This matrix is achieved in a simple economical fashion and is characterized by the fact it is more efficient and satisfactoy in use, adaptable to a wide variety of applications and unlikely to produce malfunction in the system in which it is employed.

In the prior art a matrix is generally comprised of one or more die buttons press fit in one or more bores in a die retainer plate. Since the operating ends of the die buttons are normally required to be flush with the operating surface of their retainer plate, this necessitates that not only the die buttons but the entire operating surface of the die retainer plate must be precision ground when the die buttons wear. In any case, in accordance with prior art practice, the operating surface of the die retainer plate must be ground perfectly flat and smooth to serve as a base for the material worked. By reason of the foregoing, the grinding required to initially create a matrix or to adjust it for wear is not only a time consuming and expensive procedure but one in which great care must be taken to avoid distortion of the cutting or forming edges of the die buttons.

Further, in using the matrix of the prior art as a base for the material worked it is normally required that springs in substantial number and/or having substantial strength must be applied to hold the material during a working stroke of the machine in which the matrix is embodied.

Die buttons for use in a matrix as above described have been heretofore produced in headless or headed forms. Whether headless, or headed, their axial length has corresponded, normally, to the axial length of the bore in which they are inserted, prescribed by the thickness or depth of their retainer plate. Where a headed die button has been used, the bore in which it has been arranged to nest has been counterbored in the end thereof remote from the operating surface of the retainer plate in which the bore is formed. This counterbore has been used to accommodate the head of the die button which is then arranged to form the die button base. There have, however, been headless die buttons the axial length of which has been such to provide that they project somewhat above the operating surface of the die retainer plate in which they mount, the purpose being to give increased grind life to the part.

Whether in one form or another, the matrix as contemplated in the prior art has been found to have many disadvantages, inherent in its construction and application.

Basically, the operating strength of the conventional matrix is less than desirable for a reasonably long and effective operating life. Each of the above described die buttons which represent the prior art have been formed and so applied to their retainer plate in such a manner as to be subject to sinking in use, necessitating frequent maintenance procedures. Not only this, but oftentimes their slug hole has been distorted and its diameter reduced after relatively short periods of use. The result of this last problem is to lead in some instances to machine malfunction.

For adequate strength, it has been deemed necessary in the prior art, having consideration for the matrix construction available, to give the wall of the conventional die button a relatively substantial thickness throughout its length.

The art of which applicant is aware that is most pertinent to the present invention, to the best of his knowledge and belief, includes the following U.S. patents:

| | | |
|---|---|---|
| Quinn | 407,242 | July 1889 |
| Small | 1,612,156 | Dec. 1926 |
| Bondeson et al | 1,623,824 | Apr. 1927 |
| Deubel | 1,942,539 | Jan. 1934 |
| Halstead | 2,100,846 | Nov. 1937 |
| Duncan | 2,287,168 | June 1942 |
| Lewis | 2,346,925 | Apr. 1944 |
| Sines | 2,375,445 | May 1945 |
| Barnett | 2,584,415 | Feb. 1952 |

SUMMARY OF THE INVENTION

The present invention provides a new and improved matrix consisting of a die button per se, the operating end of which is expanded relative to the remainder of its body portion. The latter portion is designed for a press fit in a suitable bore in a conventional retainer plate, which in this case functions primarily as the means that locates and maintains the matrix insert in its proper x, y orientation. In application of this die button, the peripherally projected portion of its expanded operating end seats on what would otherwise, in conventional practice, constitute the operating surface of the matrix. In the case of the present invention the relatively projected outermost end surface of the die button provides the matrix bearing surface which is adapted to receive and support the material to be worked. The retainer plate serves as a stress and shock absorbing medium as it backs the operating end of the die button.

It will be seen from the foregoing that the stress and shock of each working stroke of the tool related to each die button will be accommodated, within a concentrated and limited area. With this concentration of the load produced thereby, much less spring force is required to hold material being worked. Thus hold down springs such as normally employed in conventional die assemblies can be substantially reduced in number and/or strength and equally function. In addition to this the wall portion of the die button which positions interiorly of a bore in the die retainer plate to which it mounts may be reduced.

The invention contemplates the added feature of an insert in the periphery of the expanded operating end of each die button, to identify the level to which the matrix operating surface can be ground before replacement of the die button is necessary.

Thus, the die button of the invention becomes per se a matrix unit which utilizes its retainer plate primarily as its location device and secondarily as its support to resist shock loading. It and any associated die buttons which constitute matrix elements may be ground as and when necessary with no effect on or reworking of the retainer plate being necessary.

It is accordingly a primary object of the invention to provide a new and improved means and method of forming a matrix which is used in a stamping, press or like machine.

Another object is to provide a new and improved die button for producing a matrix in connection with a retainer plate wherein the retainer plate's function is to provide a back-up locating means and a shock and stress dissipating medium for the matrix surface afforded on the die button.

A further object is to provide a die button so constructed and related to a retainer plate to form a matrix surface displaced from the retainer plate which is readily modified and readily replaced.

An additional object of the invention is to provide new and improved means for forming a matrix in a tool and die assembly possessing the advantageous structural features, the inherent meritorious characteristics and the means and mode of use herein described.

With these and other objects in view as will more fully appear in the specification, the invention intended to be protected by Letters Patent consists of the features of construction, the parts and combinations thereof, and the mode of operation as hereinafter described or illustrated in the accompanying drawings, or their equivalents.

Referring to the drawings wherein one but not necessarily the only form of embodiment of the invention is illustrated, FIG. 1 is a perspective view illustrating die buttons the operating ends of which are expanded and applied in accordance with the invention;

FIG. 2 is a cross sectional view taken on line 2—2 of FIG. 1; and

FIG. 3 is a further cross sectional view taken on line 3—3 of the structure of FIG. 1, and in association therewith means comprising the stripper apparatus of a die assembly in which the apparatus of FIG. 1 is embodied.

Like parts are indicated by similar characters of reference throughout the several views.

Shown in the perspective view of FIG. 1 is a fragment of a die retainer plate 10 having in association therewith a series of matrix forming elements 12, 14, 16 and 18. Since the matrix elements each embody the same concept and feature a similar construction, only one thereof will be described in detail as to its construction and application to the die retainer plate 10.

The matrix element 12 as here illustrated includes a relatively thin walled tubular body portion 20 the outer surface of which has a generally cylindrical configuration which is uniform in cross section throughout its length. One end of the body portion 20 is axially extended by an integrally connected matrix portion 22. The matrix portion 22 has an annular shape and positions generally perpendicular to the longitudinally extending axis of the body portion 20. The inner periphery of the matrix portion 22 defines a passage through the center thereof which is continued by the passage defined by the inner wall surface of the body portion 20. As thus connected, the matrix portion 22 projects in a sense radially and peripherally of the outer surface of the immediately connected end of the body portion 20 and in this case provides thereon a generally ring-shaped flange.

For purposes of this description the outermost end surface 24 of the matrix segment 22, which is that remote from the body portion 20, will be considered as the matrix operating surface.

FIG. 2 of the drawings illustrates that the body portion 20 of the element 12 will be applied in a bore 26 formed in the retainer plate 10 with a press fit, in the process of which the innermost surface of the flange defined by the matrix segment 22, which surface is that remote from and parallel to the operating surface 24, will seat to the upwardly facing surface 28 of the plate 10.

The retainer plate 10 thus comprises a back-up device for the matrix portion 22 of the element 12, the surface 24 of which constitutes a matrix operating surface forming a base for material to be worked. This matrix operating surface is displaced outwardly from and generally parallel to the surface 28.

The inner peripheral wall of the matrix segment 22, which is uniform in configuration as to its cross sectional area at its head end, presents in the plane of the matrix operating surface its outermost end 32 as a cutting edge. In use thereof the edge 32 co-functions with the operating end of a punch to cut an opening in material being worked the base of which is the matrix surface 24.

Since the matrix segment 22 presents only a limited surface area serving as a base for the material being worked, any stress or shock developed in the punching operation will be directed first and primarily in a sense axially of the ring shaped flange which it provides on the operating end of the body portion 20. The force factors involved will thus tend to move initially in a primarily axial direction to and through the plate 10, the latter of which will normally be fully backed by a die shoe. It will be recognized, however, that though forces are initially transmitted axially, by reason of the much greater expanse of the plate 10 a considerable amount of the applied force will be rapidly dissipated to and through the plate 10 in a lateral sense. Under the circumstances that load is transmitted primarily through the portion of the segment 22 which forms a flange, there is little of the applied load of a working stroke directed through the wall of the body portion 20. This latter point creates the ability of the body portion 20 to be provided as a thin walled structure.

As noted previously, the elements 14, 16 and 18 are constructed similarly to the element 12 so as to provide that each comprises a relatively reduced tubular body portion which is press fit in a bore in the plate 10 and a relatively expanded integrally connected matrix segment, the latter of which disposes outwardly of the plate, abutted to and bearing on its surface 28.

It is to be understood that the arrangement of the elements 12, 14, 16 and 18 and the associated structure illustrated is not intended as a fully detailed representation of apparatus for a specific stamping or like operation. It is merely a diagrammatic showing of the same and only so much additional structure of a die assembly as is necessary for an understanding of the invention.

FIG. 3 diagrammatically illustrates the manner in which the matrix surfaces of the elements 12–18 co-function to mutually define a working platform for stock 34 which is positioned and held for working by a stripper plate 36 biased to a holding position by stripper springs 38 based in turn on a tool retainer plate 40 which mounts cutting tools 42 and 44. In the closing of the die apparatus represented in FIG. 3, the force of closing and cutting, or forming as the case may be, will be applied through the limited areas of the matrix operating surface 24 provided outermost on the elements 12, 14, 16 and 18. The arrangement provides not only for a ready and easy distribution of the applied force but dissipates such force in a manner which tends to avoid any "sinking" of the matrix elements or reduction of their slug hole cross section. The construction of the matrix elements increases the effective pressure of relatively opposed stripper or hold down springs and affords the potential of using many less or smaller springs to do the same work as heretofore provided by a multiplicity of larger and heavier springs.

It will be obvious, of course, that when wear dictates a need for grinding a matrix surface, the area of the matrix surface which must be ground is limited and does not involve a grinding of the die retainer plate in any respect. Moreover, the matrix operating surfaces of multiple matrix elements may be ground simultaneously and in a manner to easily obtain precision results.

An unexpected characteristic which will be found in use of the invention is that the parts worked will not be marked due to unnecessarily heavy loading pressures such as normally required in use of conventional apparatus directed to the same purpose.

In summary, the invention provides for a matrix surface to be displaced from a die retainer plate per se and to be changed as to its effective plane with ease and rapidity. The provision for dissipating the stress and shock of the working stroke as herein provided not only avoids breakage of tools and parts but insures more precisely cut and formed end products in production procedures wherein any material incidence of malfunction is inhibited. Of course the fact that the invention reduces the requirements for hold down and stripper springs lends considerable economy in the fabrication of die assemblies.

As shown in the drawings, the element 12 has a short radial bore 21 formed in the outer peripheral surface of its matrix portion 22, in a plane parallel to and spaced from its operating surface 24. A plug of plastic material 23 firmly seated in the bore 21 defines a visible grind limit for a matrix portion. If and when in use of the matrix element the displacement of the matrix operating surface should reach this plug, this will signal the point at which the matrix element must be replaced. This is a safety feature which insures the level of the matrix operating surface will not fall below the limit in which it may be effectively employed. This feature is an option but highly beneficial to the user employing the devices of the present invention.

From the above description it will be apparent that there is thus provided a device of the character described possessing the particular features of advantage before enumerated as desirable, but which obviously is susceptible of modification in its form, proportion, detail construction and arrangement of parts without departing from the principle involved or sacrificing any of its advantages.

While in order to comply with the statute the invention has been described in language more or less specific as to structural features, it is to be understood that the invention is not limited to the specific features shown, but that the means and construction herein disclosed comprise but one of several modes of putting the invention into effect and the invention is therefore claimed in any of its forms or modifications within the legitimate and valid scope of the appended claims.

The embodiments of the invention in which an exclusive property or privilege is claimed are defined as follows:

1. A device for providing an easily renewable or replaceable matrix operating surface, or a portion thereof, in connection with a die retainer plate, for use in a die assembly wherein a spring loaded plate unit is applied to hold material to be worked to the matrix operating surface comprising, a body including a mounting segment and a matrix segment, said matrix segment being to one end of and oriented to be generally perpendicular to the longitudinal axis of said mounting segment, the surface of said matrix segment remote from said mounting segment constituting a matrix operating surface forming a base for the material to be worked and said mounting segment being formed for a press fit in an opening in a die retainer plate, said matrix segment being laterally extended with respect to the outer periphery of said mounting segment, the lateral extension of said matrix segment providing a load accommodating portion thereof having one surface for bearing abutment to the adjacent surface of the die retainer plate to which the device is applied, said one surface of said matrix segment being parallel to said matrix operating surface and arranged to directly transmit loads applied to material thereon into and through the die plate, said lateral extension of said matrix segment having a depth to substantially displace said matrix operating surface from the surface of the die retainer plate to which it is applied and being constructed and arranged to provide for a selective displacement of said matrix operating surface toward said one surface as needs require, a peripheral wall portion of said matrix segment having means inserted therein which define the limit to which the matrix operating surface may be displaced toward said one surface of said matrix segment.

2. A device for providing an easily renewable or replaceable matrix operating surface, or a portion thereof,in connection with a die retainer plate, for use in a die wherein a spring loaded plate unit is applied to hold the material to be worked to the matrix operating surface during a material working operation, comprising, a body including a mounting segment and a matrix segment, said mounting segment being formed for a press fit in an opening in a die retainer plate and said matrix segment being laterally extended with respect to the outer periphery of the mounting segment, the lateral extension of said matrix segment providing a load accommodating portion thereof having one surface for bearing abutment to the adjacent surface of the die retainer to which said device is applied, the surface of said matrix segment remote from said one surface constituting a matrix operating surface, and said lateral extension of said matrix segment having a depth to substantially displace said matrix operating surface from the surface of the die retainer plate to which it is applied and being formed to provide for a variable displacement of said matrix operating surface as needs require, the peripheral surface of said matrix segment, intermediate said surfaces of said lateral extension, embodying means defining a limit for the displacement of said matrix operating surface.

* * * * *